United States Patent [19]

Parkin et al.

[11] 3,993,910

[45] Nov. 23, 1976

[54] LIQUID LITHIUM TARGET AS A HIGH INTENSITY, HIGH ENERGY NEUTRON SOURCE

[75] Inventors: Don M. Parkin, Los Alamos, N. Mex.; Norman D. Dudey, Glen Ellyn, Ill.

[73] Assignee: The United States of America as represented by the United States Energy Research & Development Administration, Washington, D.C.

[22] Filed: Dec. 2, 1975

[21] Appl. No.: 636,865

[52] U.S. Cl. ..... 250/499; 250/500; 313/61 S

[51] Int. Cl.[2] ..... G21G 4/02

[58] Field of Search ..... 250/499, 500, 501, 502; 313/61 R, 61 S

[56] References Cited

UNITED STATES PATENTS

| | | | |
|---|---|---|---|
| 3,500,098 | 3/1970 | Fraser | 250/501 X |
| 3,623,130 | 11/1971 | Dalrymple | 250/501 |

OTHER PUBLICATIONS

Production of Neutrons and Secondary Protons with Particle Accelerators, by J. Kukkonen, Sept. 26, 1975, Brookhaven Nat. Lab., BNL 20518, pp. 149–156.

*Primary Examiner*—Archie R. Borchelt
*Attorney, Agent, or Firm*—Dean E. Carlson; Cornell D. Cornish

[57] ABSTRACT

This invention provides a target jet for charged particles. In one embodiment the charged particles are high energy deuterons that bombard the target jet to produce high intensity, high energy neutrons. To this end, deuterons in a vacuum container bombard an endlessly circulating, free-falling, sheet-shaped, copiously flowing, liquid lithium jet that gushes by gravity from a rectangular cross-section vent on the inside of the container means to form a moving web in contact with the inside wall of the vacuum container. The neutrons are produced via break-up of the beam in the target by stripping, spallation and compound nuclear reactions in which the projectiles (deuterons) interact with the target (Li) to produce excited nuclei, which then "boil off" or evaporate a neutron.

12 Claims, 3 Drawing Figures

EH
45
47
43
L
HC
13
T
29
33
V
15
25
23
35
Z
M
55
49
41
B
D
SHIELD
52
J
I
H
G
E
W
65
53
79
64
K
11
F
C
36
57
O
17
63
27
Z
A
S
R
Y
HE
X
81
77
U
P
AIR
FAN 13
36
15
27
W
K
17
23
33
29
49
65
25

LIQUID LITHIUM TARGET AS A HIGH INTENSITY, HIGH ENERGY NEUTRON SOURCE

STATEMENT OF GOVERNMENT INTEREST

This invention was made in the course of, or under a contract with the United States Energy Research and Development Administration, or its predecessor the United States Atomic Energy Commission.

BACKGROUND OF THE INVENTION

Targets for charged particles are required for many applications. For example, they are required to produce an intense beam of fast neutrons. One target system for producing an intense beam of fast neutrons, which is described in Report AECL-2750, dated July 1967, by the Atomic Energy Commission of Canada, Ltd., involves proton bombardment of a column of lead-bismuth inside and completely enclosed by a pressurized Zircaloy tube. However, the neutrons produced directly, since they were thermal neutrons, required neutron multiplication around a Zircaloy tube that passed axially through a moderator vessel and shield, and a beam transport system that guided the proton beam to the top of a shield and thence downward into the target.

SUMMARY OF THE INVENTION

By the present invention, a lithium target jet is provided for charged particles for the production of fast neutrons. To this end, the target jet is a free-falling, sheet-shaped, copiously flowing, liquid lithium jet. Advantageously, the target falls across and in contact with the end of a vacuum container means forming a neutron window. By providing a high energy charged particle beam in the vacuum container means, the beam breaks up on the target by stripping, spallation and compound nuclear reactions in the vacuum to cause the deuterons to disintegrate and boil off into a neutron beam in the same direction as the charged particle beam having about half the energy of the charged particle beam. The neutron beam passes through the neutron window. Meanwhile, the container is connected to a low pressure ambient produced by an accelerator system for producing the charged particle beam along a trajectory normal to the direction of the liquid lithium. Also, the liquid lithium is recovered and recirculated back again in a closed cycle for continuously producing neutrons with a deuteron beam that relatively continuously impacts the target at right angles thereto.

Advantageously, the target apparatus of this invention comprises, a charged particle beam, vacuum container means having an inside wall for receiving the beam, vent means on the inside of the vacuum container means adjacent said wall and directed along a trajectory transverse to the charged particle beam, and a copiously flowing, liquid lithium jet that gushes from the vent on the inside of the vacuum container means and falls by gravity to form a moving web in contact with the inside wall of the vacuum container means for receiving the beam to produce to neutron beam in the same direction as the charged particle beam. In one embodiment, this invention provides a first source means for producing a beam of deuterons, vacuum container means for transporting the deuterons toward one of the ends of the container means along a longitudinally extending beam axis in a vacuum; second source means of a flowing liquid lithium stream having a first conduit and a nozzle connected thereto to define a narrow vent on the inside of the container means adjacent one end thereof, the nozzle converting the flowing liquid lithium stream in stages from a round cross-section to a rectangular cross-section jet that flows in and exposed to the low pressure ambient by gravity across the container means along the end thereof on an axis transverse to the axis of the container means to interact the liquid lithium target jet with the beam of deuterons in the low pressure ambient in the container means; and recovery means on the opposite side of the container means from the nozzle for receiving the target jet and cooling it for replenishing the second source means for circulating the liquid lithium in a system having a closed cycle for continuously yielding high intensity, high energy neutrons with at least one continuous high intensity, high energy deuteron beam. Thus, the lithium target jet is used as a heat removal vehicle, so as to provide a low vapor pressure at elevated temperatures that permits the target jet to be introduced into the accelerator vacuum system for producing the deuteron beam.

OBJECTS OF THE INVENTION

It is an object of this invention, therefore, to produce a target jet for charged particles;

It is another object to produce neutrons by relatively bombarding a beam of charged particles in a vacuum against a target jet;

It is another object to produce a sheet-shaped target jet that is transported across the vacuum in a container for a charged particle beams, It is another object to cool a liquid lithium jet in a closed cycle.

The above and further novel features and objects will appear more fully from the following detailed description of one embodiment when the same is read in connection with the accompanying drawing, and the novel features will be pointed out in the appended claims.

BRIEF DESCRIPTION OF THE DRAWINGS

In the drawings, where like elements are referenced alike.

DETAILED DESCRIPTION OF THE PREFERRED EMBODIMENT

This invention is useful in producing neutrons. As such, this invention is useful for the wide variety of applications to which the neutrons known heretofore have been applied. More particularly, the best mode of this invention is useful for producing high energy (fast neutrons) for testing materials via the break up of charged particle beams by stripping, spallation and compound nuclear reactions on a liquid lithium target jet.

Figures 1, 1A:
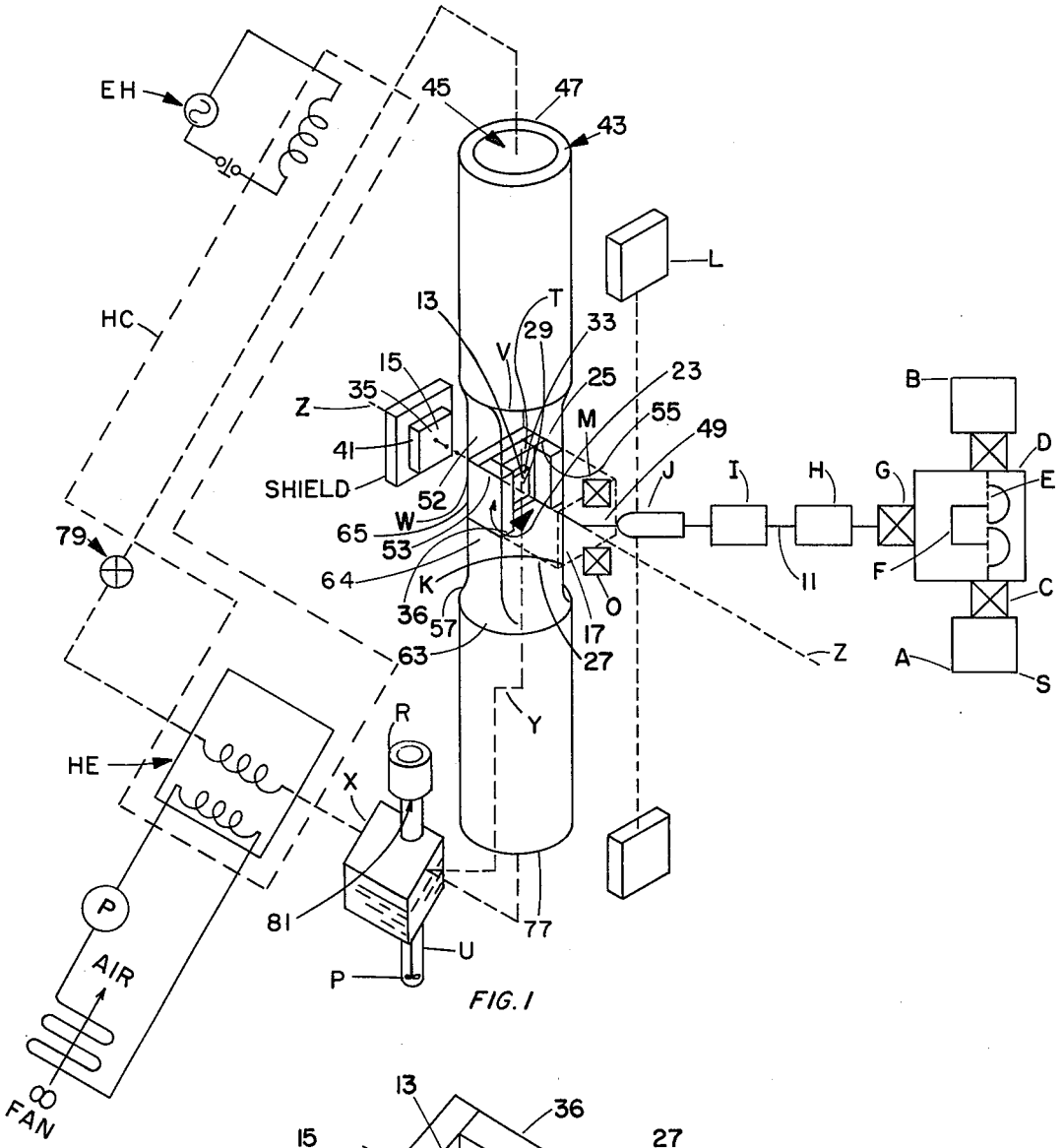
FIG. 1 is a partial schematic diagram of the vertically aligned target film of this invention.
FIG. 1*a* is an enlarged view of the neutron window of FIG. 1.
Figure 2:
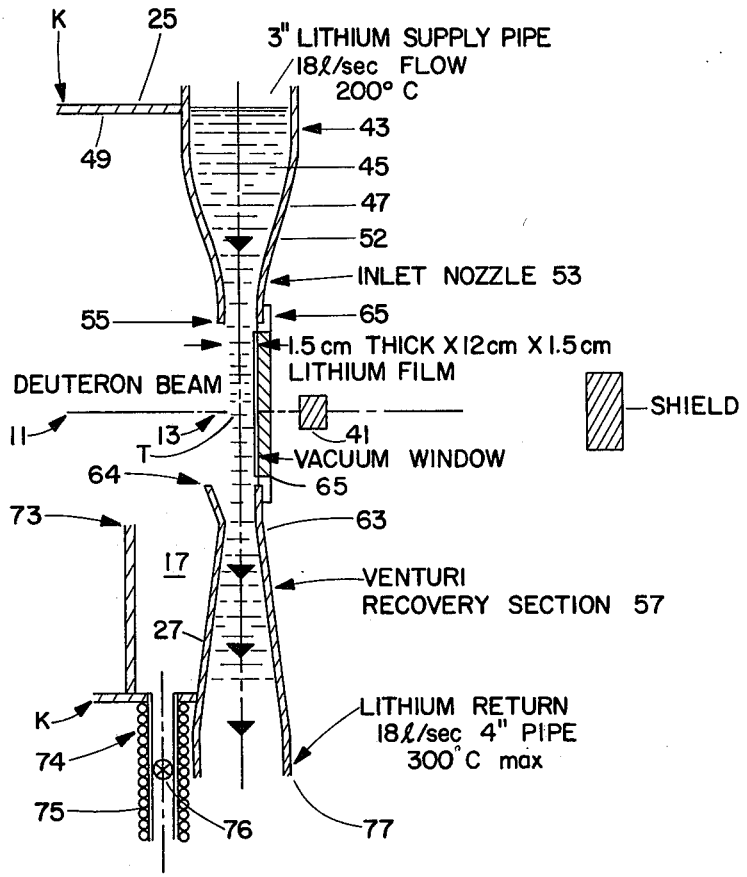
FIG. 2 is a partial cross-section of the nozzle and recovery system for the target film of FIG. 1.

Referring to FIGS. 1, 1*a* and 2, it is known that beams of high energy charged particles may be piped along a beam axis over long distances in a vacuum by using a longitudinally extending vacuum container means and quadrupole magnetic lenses for focusing the beam along the container axis. A longitudinally extending vacuum container means having linearly extending accelerator means (referred to in the art as a Linac), and quadrupole magnetic lenses for focusing and tansporting the charged particles in a vacuum along the longitudinally extending axis in the container means, are shown and discussed in U.S. Pat. Nos. 2,882,396 by Courant et al, and 3,374,378 by Courant on the "Acceleration of Heavy Particles;" "The Linear Accelerator Injector for the AGS," by S. Giordano, reprinted from the 1960 International Conv. Record, Part 9; and "The Strong — Forcusing Synchrotron — A New High Energy Accelerator" by E. D. Courant, M. S. Livingston and H. S. Snyder, in the Physical Review, Vol. 88, No. 5, pages 1190–1196, Dec. 1, 1952, all of which are incorporated by reference herein. FIG. 1 of the Courant U.S. Pat. No. 3,374,378 illustrates a linear accelerator system, and FIG. 1 of the Giordano publication shows the longitudinally extending vacuum container means and the quadrupole focusing system for producing the desired high energy beam along the container axis. Transport of the accelerated particles by this type of vacuum container means and magnetic focusing system is based on the fact that all of the particles making up a particular accelerated beam are contained in a train of bunches of charged particles having a small velocity distribution, so that after the particles leave the Linac, the accelerated particles debunch into a dc beam of particles having substantially the same momentum. The accelerator, focusing means, vacuum container means, and the beam and background particles and mathematics of such beams and their vacuum and transport systems are well known in the art. The invention hereinafter described utilizes a transport system of this type in which the charged particle beam and the low pressure (vacuum) ambient in the container means through which the beam passes are traversed in a manner described below in connection with particular configurations of these beams by a free-falling, copiously flowing, liquid lithium jet that gushes by gravity from a vent on the inside of a vacuum container means to form a moving web in contact with the inside wall of the container means for receiving the beam to produce a neutron beam in the same direction as the charged particle beam. Thus, the target jet falls across the charged particle beam in the vacuum space in the container means so as to produce neutrons via break up of the beam by stripping, spallation and compound nuclear reactions. To this end, the charged particles, which are selected from the group consisting of $H^1$, $H^2$, $H^3$, $He^3$, $He^4$, Li, C, and other elements capable of producing the neutrons in which high heat loads must be removed from the target, are likely to break up in a stripping or spallation action or in compound nuclear reactions when they hit a lithium target. A mathematical treatment of the principles involved in this invention, is given in Report BNL 20159, which is a July, 1975 proposal submitted by Brookhaven National Laboratory to the U.S.E.R.D.A. and entitled, "Proposal for an Accelerator-based Neutron Generator," which is incorporated by reference herein.

In a practical embodiment of the charged particle beam source, sources S comprise conventional and ion sources (A and B), triplet magnets C, bending magnets D, defining slits E, buncher F, quadruplet magnet G, diagnostic means H, linac I, and bending magnet J, which bends the path of the beam into vacuum containers K, for transporting the beam into target caves L, having solenoids O for sweeping the beam across the target of this invention, and quadrupole magnets M for transporting the beam to the target jet T.

In order to explain how the method and apparatus of this invention accomplish the function of disintegrating an accelerated charged particle beam 11 by interaction with a metal target jet T having a cross-sectional area 13 that produces neutrons 15 in a low pressure (vacuum) ambient 17 in a longitudinally extending evacuated container means K for the accelerated beam, reference is made to FIG. 1, wherein is illustrated the z-z container axis representing the path prior to alteration traveled by a round cross-section beam of accelerated particles to undergo disintegration. Disposed along the z—z axis at the inside downstream end 23 of the container means is the target jet T, each atom in the target, as is understood in the art, tending to be heated while disintegrating the projectiles impacting thereon along the z—z axis in some particular plane, such as either the *x* or *y* planes (in a cartesian coordinate system) at right angles to each other and passing through the z—z axis, as is understood in the art. Each heated target atom must be cooled to obtain a neutron beam along the z—z axis, since the incident beam would vaporize an uncooled target and simply burn a hole in a stationary target through which the charged particle beam would pass without causing the charged particles to disintegrate.

Should a free-falling, copiously flowing, liquid metal target cross-section 13 be transported across the inside end of the container means K from one side 25 to the other side 27 thereof as a sheet-shaped target jet T along a path 29 that intersects the z—z axis at the right angles thereto in a direction indicated by arrow 33, it is seen that the beam 11 is capable of yielding a high intensity, high energy (fast) neutron beam 35 along the z—z axis in the direction the beam is traveling so that the neutron beam hits a desired material 41 outside the vacuum container. To this end, the beam 11 is capable of operating at high intensity and high energy without burning a hole in the target jet T because the liquid metal target jet is continuously cooled, circulated in an endless stream that replenishes itself, and is used as a heat removal vehicle to remove the heat produced from the low pressure (vacuum) ambient in the container means at the impact point of the beam and target along the z—z axis. Moreover, should the free-falling, liquid lithium target jet be used in the same vacuum as the charged particle beam, the low vapor pressure of the target at elevated temperatures can be controlled to permit the target to be introduced into the accelerator vacuum system for producing the beam in the container means K along the *z—z* axis. To this end, the bending magnet J is used to separate the beams' positively and negatively charged components from sources A and B and to direct each towards target caves L, which are symmetric with respect to the axis of the system of source S. This arrangement prevents the target vapor from reaching the sensitive structures of linac I, since atoms or ions of target material cannot follow the bend imposed by magnet J on the trajectories of the acclerated ions. Instead, they will hit the wall of vacuum container K before or in the vicinity of the bending magnet and condense there to a fluid or solid, depending on the local temperature of the wall. Additionally, lithium has an enormous latent heat of vaporization. Also, the highest temperature lithium is confined in a cubic cross-sectional area inside the liquid lithium target jet T. To this end, a jet that is larger across than the incident beam freely falls on the inside of the neutron window W at the end 23 of the container K, and is confined on three sides in the vacuum of the container means by the neutron window W and two plates 36 normal thereto. To this end, the jet gushes by gravity from a rectangular cross-section vent on the inside of the vacuum container to form a moving web or film in contact with the inside wall of the vacuum container for receiving the charged particle beam to produce the desired neutron beam in the same direction as the incident charged particle beam.

A practical arrangement for producing the desired neutrons in a low pressure (vacuum) ambient by relatively bombarding the bent incident beam in its low pressure (vacuum) ambient against a free-falling, non-circular, gushing, liquid lithium, target jet that is transported across the vacuum in the container for the incident beam and then recovered for replenishing the target jet in a closed cycle that endlessly circulates the liquid lithium, is illustrated in FIGs. 1, 1a and 2. Shown there is an arrangement of a source S of accelerated charged particles in a beam 11 located on a horizontal z—z axis in a vacuum ambient 17 in a longitudinally extending evacuated container means K. The bent beam travels in the vacuum 17 in the container means K from the source S toward the downstream end 23 of the container means K where the beam 11 bombards with high intensity a cubic cross-sectional area 13 of the liquid lithium target jet T that is buried in the jet on three sides and at both ends. Thus, the described jet has a larger cross-sectional area than the incident charged particle beam to which it is openly exposed on the side thereof that is impacted by the beam 11. This produces the desired neutron beam 35 that passes from the container means K through neutron window W, which is interposed between the neutron activated material 41 and the low pressure ambient 17 in container means K to preserve the integrity of the vacuum therein.

To obtain the desired gushing, non-circular, cooled, liquid lithium target jet in the vacuum 17 in one embodiment, a liquid metal system of distribution 43, referred to in the art as a liquid lithium supply, produces a flowing liquid lithium stream 45 having a right circular cross-section in conduit 47, which is disposed in the one side 25 of the container means K to penetrate the wall 49 of the container means. A transition piece 52 forms a nozzle 53 defining a narrow vent 55 in the side of the container means adjacent the end 23 thereof to speed up the lithium flow in the target jet T. Directly under the vent 55 there is located a recovery means 57 on the other side 27 of the container means from the nozzle for collecting. capturing and recovering the free-falling, non-circular, gushing, liquid lithium target jet, and converting it back again to a cooled flowing liquid lithium stream for replenishing the system of distribution 43, so as to circulate the liquid lithium endlessly in a closed cycle that removes the heat generated in vacuum 17 at its interface with the target jet T substantially without contaminating the low pressure ambient in the container means K and its connecting source S of charged particles with lithium from the jet T. To this end the recovery means 57 merely drains the jet T into a second container X at the same pressure as the first container K, while pipe Y maintains the same vacuum container pressures, which are advantageously low, and a buried lithium filled column U containing an impeller P connected by a long shaft to a pump motor R supplies sufficient head of liquid lithium to the impeller to prevent cavitation, while the impeller rotates to give the liquid lithium sufficient velocity against friction endlessly to circulate the lithium in a circuit in a closed cycle having a heater-cooler HC for maintaining the desired liquid lithium temperature. To this end, the cooler uses forced air in a conventional heat exchanger HE to cool the lithium, and an electric heater EH in the same heat exchanger initially brings the lithium up to the desired temperature. To this end also, all the lithium lines are insulated and heated by electric heating elements before the lithium is circulated therein, and to help drain the lines through suitable drains before shut-down.

Advantageously, the nozzle 53 has a transition piece 52 for converting the round cross-section lithium stream in the conduit to a partially free-standing, rectangular cross-section, sheet-shaped jet that forms a moving web in contact with the end wall portion of the container forming window W. Likewise, the recovery means 57, which is in the bottom side 27 of the container means opposite to the nozzle, has a similar transition piece 63 that catches the jet T in a wide, partially funnel-shaped mouth 64 of rectangular cross-section so as to convert the rectangular cross-section jet T back again to a round cross-section flowing liquid lithium stream for circulation and cooling in heater cooler HC. This rectangular cross-section jet thus maximizes the production of the desired neutrons 15 in beam 35 at the bulkhead 65 forming the neutron window W between the neutron activated material 41 and the low pressure (vacuum) ambient 17 in container means K so as to maintain the integrity of the vacuum in the vicinity of and adjacent to the material 41.

To maintain the rectangular cross-section of the jet T in vacuum 17 the neutron window W contacts one side of the jet to cause the jet to hug the inside of the neutron window in the low pressure ambient in the container means. Likewise, two side extensions 36 produce a like hugging effect on the two sides of jet T adjacent to the neutron window W, while the fourth side of the jet, opposite to the window W, is open and free-standing and exposed to the vacuum 17 in container means K. Thus, the material 41 receives a high flux neutron beam 35.

To avoid the possibility that any excess lithium not caught by the recovery means spills, or otherwise enters the vacuum 17 and/or its connecting source S, an auxiliary catch basin 73 having a cold trap 74 receives any such excess. A drain 75 having valves 76 removes the lithium from the catch basin for return to the lithium system of distribution by conventional means. One such conventional system is shown schematically by a dotted line as a conduit 77 having valves 79, a pump 81, and a heater-cooler HC. Also an electric heater EH is provided to heat the lithium initially, and conventional liquid nitrogen cooled traps catch any vaporized lithium. Finally, conventional shielding is used.

In the operation of one example of this invention, a beam of accelerated charged particles having a 10 cm diameter focused on an area of 80 $cm^2$ normal to the vertical is directed along the $z$—$z$ axis from a conventional accelerator source S, such as is well known or understood in the art from the above-mentioned references. Advantageously, this accelerator source produces high intensity, beams in long and continuous pulses in a known manner. The liquid lithium jet T gushes from a 3 supply conduit 47 at up to about 400° F. A 3 I.D. × 4 × ½ venturi transition piece 52 — round to rectangular (approximately 25° total included angle) — transports the liquid lithium from the conduit 47 to the vent 55 of nozzle 53. Thereupon the rectangular cross-section liquid lithium jet T forms a sheet-shaped web, which is 10 × 10 × cm, flows at up to 600 cm/sec (20 ft/sec) or more, and falls in vacuum 17 across the z—z axis at right angles thereto, where it is impacted by the deuteron beam 11 to produce the desired beam 35 of neutrons 15 that pass from the low ambient pressure in container means K through neutron window W to impact against material 41. While high neutron fluxes are produced and impacted on a niobium or lithium material 41, the system can be used on a wide range of other materials and purposes, particularly since $D^+$, $D^-$ and other beams can be selectively employed. Typical target jet T parameters are shown in Table I.

The recovery means 57 has a wide partially funnel-shaped mouth 64 of rectangular cross-section that catches the liquid lithium jet T, converts it to round cross-section, and circulates it through a standard heater-cooler having a standard system of distribution 43 continuously to replenish the jet T and endlessly to circulate the liquid lithium therein in a closed cycle. Since the temperature of the lithium is below about 600° F, stainless steel piping can be used with low corrosion. However, the lithium can be above 399° C, which is the wetting temperature for a stainless steel neutron window W. Since the maximum surface temperature of the jet T determines the evaporation rate, the evaporation rate can be kept quite small by keeping the maximum jet surface below 400° F. This can easily be done by selectively increasing the jet flow rate. Additionally, conventional vapor cold traps 74 can be used for purging the vacuum 17 in container means 19 of impurities, such as tritium and/or lithium deuteride.

In the arrangement of FIG. 1 a vertical, centrifugal, mechanical, hot, well type, sump pump is used having a shaft that is up to 5–10 feet or more long. While the pump shown has one impeller, impellers in series to boost the input velocity to the second impeller can be used. These vertical mechanical pumps are patterned after the Economy Peerless, Byron Jackson, pumps or the liquid bismuth pumps used for the LMFBR tests at Brookhaven National Laboratory.

Alternately, flat linear induction pumps or electromagnetic pumps are employed. The helical electromagnetic pump would be similar to G. E. manufacture, consisting of one or more turns of pump channel. The MSA standard linear induction pumps are described in MSAR-72-91A by Mine Safety Appliances Co.

The following are illustrative examples:

EAMPLE I

A 60,000 CFM, 62'/sec, overall U = 22.7 BTU/FT²/HR ° F, 100° F air, ΔP = 6–10 in. $H_2O$, 25–50 horsepower fan cools the lithium as it circulates through a finned 4 × 8 × 4 tube cooler having 440 feet of ¾ inch finned tubing, with 20 pipes in parallel making 9 passes with a cooling duty of about 10 × $10^6$ BTU/hour. The lithium pump, which is at least 5 H.P. pump, receives the lithium from the recovery means in a 3 inch diameter S.S. pipe line at up to 600° F and 18 l/sec or 8.7 Ft/sec, and circulates the lithium through the finned tube cooler to the jet at up to 400° F through a 3 inch diameter line to absorb energy from the deuteron beam. A vacuum interconnection is made between the second lithium container for the lithium pump and the vacuum 17 in the first container means K for balancing purposes.

An auxiliary air heater and an electrical coil heater are used to get the system started. To this end, a heater warms the cooler coil to 400¼ F. The latter warms all the remaining lithium initially.

EXAMPLE II

The steps of Example I are repeated using the basic linac parameters of Tables II, III and IV for producing a deuteron beam in a container having a vacuum of at least $10^{-5}$ Torr according to the well understood theory of linear accelerators described in the above-cited BNL report and the references cited on page 45, thereof, which are incorporated by reference herein, such as, "Particle Accelerators" by Livingston and Blewett, Chap. 10, McGraw Hill, 1962.

EXAMPLE III

The steps of Example II are repeated using the linac built at Chalk River, Canada, combining 100-mA beam current and cw 100% duty factor operation for accelerating deuterons.

EXAMPLE IV

The steps of Examples I–II are repeated using the 200 MeV Linac at Brookhaven National Laboratory to accelerate deuterons in either pulses or continuous generation.

EXAMPLE V

The steps and apparatus of the previous examples are used and repeated using two 500 kV. 0.5A, direct current generators to permit simultaneous acceleration of $D^-$ and $D^-$ ions. The positive ions are from the duoplasmatron source at the Brookhaven (BNL) 200-MeV Linac injector for the BNL AGS. This source is generated at currents up to 0.5 A. The system employed utilizes a double-gap coaxial transmission line resonator operating at up to 50 MHz through which the beam passes twice, once as it enters a 270° bending magnet D and once as it exits from the magnet. Slits E placed at the maximum dispersion point within the magnet will interact those particles that are outside the energy-acceptance region of linac I. Four to six separately-energized quadrupole magnets G are used to match the injected beam in the radial acceptance of the linac using the conventional diagnostics in diagnostic H.

The linac I is a drift-tube accelerator whose parameters are understood from the above-mentioned tables. High power vacuum tables are available for service up to 2 MW at frequencies up to 30 MHz, and some of these tubes and their variations run at reduced power levels at frequencies of 50–110 MHz, typically 600 kW cw and 1.5 MW for long pulse operation. Illustrative radio frequency parameters are listed in Table V. A block diagram of the rf system is shown in FIGS. IV-2 on page 56 and on page 62 of the above-identified BNL Report 20,159, which is incorporated by reference herein.

EXAMPLE VI

The parameters, steps and apparatus of the above Examples are employed and repeated using 120 cu ft drums (about 15–50 gal. 1,700 kg) of natural lithium in stainless steel transport tubes and pipes according to the flow diagram shown in FIG. V-2 on page 69 of the above-mentioned BNL report. Since lithium melts at 354° F, all the lines are initially heated by resistance wire heaters to 400° F before any liquid lithium is introduced into the system. Electromagnetic or mechanical centrifugal pumps are used, while cold-trapping and hot-trapping are used to remove lithium-deuteride and lithium tritide, and greater than atmospheric pressure is used where possible to prevent the formation of lithium oxide.

EXAMPLE VII

The previous examples are repeated using nickel metal neutron shielding, and the buildings shown in the above-mentioned BNL report gased upon the neutron time-of-flight test results obtained at the U.S. Navy Research Laboratory Cyclotron Facility, as reported in the Report of NRL Progress, April 1973 (see pages 44 and 25 of BNL 20,159), whereby the neutron spectra were determined from the (d,n) reactions in a thick natural lithium target, which was a cylinder 2 cm long and 2 cm in diameter. Data was obtained for five deuteron energies, which are nominally 14.5, 20, 25, 30 and 35 MeV, as shown in FIG. III-1 on pages 26 of BNL 20,159, which is incorporated by reference herein. The energy of the deuterons incident on the LI was approximately 1–1.5 MeV lower in each case when the beam left the vacuum before entering the target.

A 5-cm diameter NE-213 liquid scintillator coupled to a photomultiplier tube was to detect the neutrons at the end of the 3-m flight path. The fast timing signal from the photomultiplier assembly determined the arrival of the neutrons.

At 12.8 MeV and 33.8 MeV, angular distribution data were taken for angles of 0°–20° in 5° intervals. In addition, the Be (d,n) energy spectrum was measured in the forward direction at 33.8 MeV for comparison with earlier NRL results taken when the target was inside the cyclotron vacuum chamber.

FIG. III-2 on page 28 of BNL 20,159 shows the Li (d,n) neutron spectra for the five deuteron energies mentioned above. As predicted the mean energy of the neutrons increases with increasing dueteron energy and is approximately 0.4 $E_d$, i.e., almost half the incoming deuteron energy. The yield also increases with increasing energy as reported by others. Also, the FWHM of each distribution is in reasonably good agreement with that predicted by Serber's stripping theory, taking into account a thick target was used that stopped the forward deuteron motion in the lithium target at $R_o$ in the drawings (Phys, Rev. 72, 1008 (1947), which is incorporated by reference herein).

Deuteron breakup is the predominant reaction in the target. For 30-MeV deuterons the angular distribution of the resultant neutrons has an approximate FWHM, as described on page 24 et seq of BNL 20,159. Also, the energy distribution has its maximum near 14 MeV with an approximate FWHM, as described on page 25 of BNL 20,159.

The measured neutron yields are tabulated in Table VII.

EXAMPLE VIII

The steps and apparatus of the previous Examples are repeated using substantially rectangular cross-section, free-standing, lithium, laminar flowing, sheet-shaped, jet of lithium confined in a vacuum of only three sides to form a sheet, web or film having Reynolds numbers of 20,000. According to tests described in BNL 20,159, which are performed at the Harry Diamond Laboratories, Adelphi, Md., laminar flow is possible at Reynolds numbers up to one million or more in liquid lithium. Also, the sheet of lithium can be completely free standing or confined on three sides as shown in the drawing, since the lithium target cross-sectional area 13 is confined in the liquid lithium target jet T on three sides, as shown in the drawing.

It was found that energy deposited uniformly in the lithium produces a maximum temperature rise that can be kept to 300° C with a mean flow velocity of 2.4 m/s. In one example, stream velocities are about 10 m/s to keep the temperature below the boiling point for the desired internal pressure. However, the incident energy can be absorbed by the enormous latent heat of vaporization of lithium, in which case the velocity may be reduced to 1 m/s. The resultant Weber number for the free surface flow is 23, and the associated nozzle-width Reynolds number is $1.6 \times 10^4$. A simple stability analysis indicates that under the conditions stated the flow should be laminar, and photographic evidence seens to verify the laminarity of the flow with a variety of conventional nozzle designs. However, turbulent flow, even if possible, is also believed to be operable to produce neutrons in the described system.

EXAMPLE IX

The steps and apparatus of the previous Examples are repeated using conventional liquid metal pumps. Such pumps, are available that are capable of high flow rates. For example, conventional pump parameters are given in the above-cited MSAR 72-91A and Table VI.

In this example a centrifugal pump is mounted below ground to develop the desired input head from the second container, since lithium has a density about half that of water. However, an electromagnetic pump can alternately be used.

EXAMPLE X

The steps and apparatus of the previous Examples are repeated using a conventional saw-tooth, radio-frequency, electrical signal generator feeding a conventional solenoid for sweeping the incoming deuteron beam across the sheet-shaped, liquid lithium, target jet.

EXAMPLE XI

The steps of the previous Examples are repeated using a defocusing magnet to blow-up the incoming deuteron beam in the $x$ direction (in an $x$—$y$—$z$ cartesian coordinate system) to change the 10 cm diameter round cross-section incoming deuteron beam to a 1 × 10 cm rectangular cross-section deuteron beam.

EXAMPLE XII

The steps and apparatus of the previous Examples are repeated using a 100-mA, 30-MeV deuteron beam that is 10 cm wide and 1 cm high impinging on a 1.5-cm-thick sheet-shaped cross-section of the lithium jet. The vertical deuteron beam intensity profile is approximately Gaussian, uniform horizontally, and is referred to in BNL 20,159 as source H.

FIG. III-4 of BNL 20,159 shows the neutron flux for various source geometries as a function of distance $z$ from the source exit surface, e.g., a square source 10 × 10 cm with constant intensity profile, a square source 1 $cm^2$, and a 1-cm-diam deuteron beam for a lithium flow rate of 20–50 m/sec, and/or where the high latent heat of vaporization is used for heat dissipation.

EXAMPLE XIII

The primary $D^+$ beam is continuous and the $D^-$ beam is pulsed so that the linac pulls one beam and pushes the other in the troughs and valleys of the rf Linac (accelerator) wave. The primary beam is circular ~ 1 cm in diameter, and roughly Gaussian in beam density profile. There are two ways of producing the desired 1 × 10 cm source area on the lithium target: by defocusing in the horizontal direction with a solenoid O, or sweeping it through 10 cm electrostatically overy the horizontal dimension at MHz frequencies.

EXAMPLE XIV

The steps and apparatus of the previous Examples are repeated. The $D^+$ beam is continuous and the $D^-$ beam is pulsed, while the bending magnet J separates and directs the respective deuteron beams to the desired nickel shielded target caves, e.g., the cave shown where a saw tooth generator for a solenoid O sweeps a 1 cm high $D^+$ deuteron beam back and forth across a 10 cm lithium target cross-sectional area at rf frequencies. The maximum energy spread possible is limited by the particle bunches in the linac, so that achievement of the desired dc $D^+$ beam requires a certain drift distance between the linac I and the vacuum exposed lithium target film T. The system of this invention easily achieves an energy spread of 1 MeV (full width — half maximum — FWHM) for a dc beam produced on lithium target jets T 60 m downstream of the linac I. The energy spread is desirable in itself, since it spreads the energy deposition range in the target jet T.

EXAMPLE XV

The steps and apparatus of the previous Examples are repeated except that the round cross-section beams are replaced by electrostatic defocusing means in place of a solenoid.

EXAMPLE XVI

The steps and apparatus of the previous Examples are repeated using the linacs I described in the cited references according to the principles described in the above-cited Courant "Heavy Ion" accelerator patent.

EXAMPLE XVII

The steps and apparatus of the previous Examples are repeated using various pipes, transition pieces, recovery means and nozzles. For example, annealed, carbide coated Nb-l Zr is used.

Metals like Mo, Nb, or Nb-lZr , Re, Ta, V, W, Zn and some alloys of them can be used up to 800–1000° C with negligible attack at least for several months. Austenitic and ferritic stainless steels and pure iron are good for use up to 600°–700° C. Beryllium is good up to 600° C. One of the most promising ceramics for resistance to lithium at 375° C is hot-pressed and high purity BeO.

The errosion resistance of several materials was tested, e.g., Au 10930° C with lithium impinging at velocities from 33 m/sec to 45 m/sec has been measured in **100-*h* test, as reported in NASA Report 32–1150 (see pp 108 and 109 of BNL 20,159), which are all incorporated by reference herein. An Nb-lZr specimen was nearly unaffected, but W-2 $ThO_2$, TaC, TiC, and ZrC were badly eroded. The flow nozzles are also Nb-lZr. The velocity of the 1,083° C lithium was between 55 and 82/sec in the nozzle during the 100-*h* tests. No clear defects in the nozzle were detected. In other tests of hot lithium flowing through Nb-lZr pipes for 10,000 h, no corrosion was found for velocities of 6–12 m/sec. Nb-lZr can be used between 760° and 1,300° C for lithium flow of 45 m/sec at least for 20,000 h (or 2–3 years), as shown by the IAEA publication "Alkali Metal Coolants." The temperature difference between lithium and the wall was 110°–540° C. The reistance of various materials to wear in lithium from 316° to 538° C has been measured by rubbing rotating discs against curved and flat shoes in lithium. Molybdenum-cemented TiC, NbC and WC and carbide coated Nb-lZr had excellent characteristics at 538° C, but untreated Nb-lZr and T-111** were very poor.

The lithium cavitation tests at 260° C and 816° C for 10 h showed a more severe damage rate at lower temperatures. Mean depth of penetration was 3.8 $\mu$m in Nb-lZr and 25 $\mu$m is annealed Nb-lZr. The lowest depth was 0.77 $\mu$M for T-111. At 816° C the cavitation rate in lithium is greater than in water, but less than in other liquid metals, as discussed in High Temperature 7, 65, which was incorporated by reference herein from page 109 of BNL 20,159.

EXAMPLE XVIII

The steps and apparatus of the previous Examples are repeated using the highest temperature liquid lithium target cross-sectional area confined about 0.4 cm inside the boundaries of a 1.5 m × 12 cm × 1.5 cm film (on three sides) so that there is no problem of maintaining the desired dimensional stability of the described sheet-shaped lithium target jet, which is at least partially free standing (e.g., on one side) and is directly exposed to the low pressure vacuum in the linac exit line or vacuum container. Thus, the neutron window is protected from burning from the deuteron beam by the cooled, liquid, endlessly flowing, lithium target. Table VIII shows the vapor pressure of lithium as a function of temperature.

In this example, wherein the deuteron beam and the resultant protons are stopped in the sheet-shaped liquid lithium target jet before the beam can cross the jet, the accelerator and container pressure are between about $10^{-5}$ and $10^{-6}$ Torr, so that the lithium temperature is between 305° and 350° C. However, the internal pressure of the jet in the beam area, is higher than the ambient pressure because of the radiation pressure of the deuteron beam in the 1 cm × 10 cm = 10 $cm^2$ target area, i.e., about 0.83 torr. Thus, the hottest point of the jet is below the equilibrium boiling point as it exits the deuteron beam. Additionally, even where the boiling point of the liquid lithium reached, the substance cannot be made to "boil" until additional heat equal to the latent heat of vaporization is added to the liquid. With the enormous latent heat of vaporization of liquid lithium being 22 × $10^3$ J/g at 750° C, there is a large safety factor built in that allows a much higher "effective" temperature rise than 750° C. Still further, the beam is not completely mono-energetic, such that the jet velocity could be lowered from 10 m/sec to 1 m/sec with no problem. However, the temperature in the closed cycle endlessly circulating lithium loop is between 300–400° C to minimize corrosion.

EXAMPLE XIX

The steps and apparatus of the previous Examples are repeated and the tritium, deuterium and other impurities that are produced, and/or that combine with the lithium are removed by cold trapping in the linac vacuum container, a sump at the bottom of the catch basin, and at frequent intervals from the closed lithium cycle lines.

EXAMPLE XX

The steps of the previous Examples are repeated alternately using continuous and pulsed $D^+$ beams in combination with pulsed $D^+$ beams.

EXAMPLE XXI

The steps of the described examples are repeated using a jet of "doped" lithium to produce specific components. For example, lithium tritide is added to the described Li-jet to produce a "14 MeV" component in the neutron spectrum via the $(d, t)$reaction.

EXAMPLE XXII

The steps of the described examples are repeated using charged particle beams selected from tthe group consisting of accelerated nuclei of such elements as $H^1$, $H^3$, $He^3$, $He^4$, Li, C, etc. capable of producing neutrons by bombarding a lithium target jet in which large heat loads (i.e., high energy deposition in the target) must be removed from the target.

This invention has the advantage of providing a liquid metal target jet capable of producing neutrons from any accelerated particle in which large heat loads (i.e., high energy deposition in the target) must be removed from the target. To this end, this invention transports a falling, non-circular, gushing liquid lithium jet in the form of a sheet-shaped web 1.5 cm × 12 cm × 1.5 cm having a target area 13 at least 0.4 cm inside the film boundaries. Still further a continuous beam is produced by an accelerator source along a trajectory normal to the direction of the liquid lithium jet so as to produce a continuous neutron beam. The liquid metal system of this invention has the advantage of recovering and cooling the liquid lithium after it is impacted by the incident beam in a vacuum for endlessly recirculating the recovered lithium back again across the beam trajectory in a closed cycle, while maintaining a low enough lithium vapor pressure at an elevated temperature to permit the introduction of the lithium into the accelerator vacuum system without contaminating the same with lithium background impurities. To this end, the lithium jet is a sheet-shaped web that is continuously replenished and cooled to remove the heat generated in accordance with the vapor pressure of the lithium so as to keep the vacuum from being degenerated. Also, the beam is bent after it is accelerated and before it hits the lithium jet.

TABLE I

| Target Parameters | |
|---|---|
| Beam power | 3 MW |
| Beam diameter | 10 cm |
| Minimum beam area | 78.5 $cm^2$ |
| Maximum beam area | 100 $cm^2$ |
| Deuteron range | 1.12 cm |
| Jet size | 2 cm × 10 cm |
| Film size | 1.5 cm × 12 cm |
| Jet flow rate | 600 cm/sec |
| Film flow rate | ~ 10 m/sec |
| Melting point of lithium | 180.6° C |
| Boiling point of lithium | 1343° C |
| Lithium entrance temperature | ~ 200° C |
| Lithium exit temperature | ~ 280°C |
| Lithium vapor pressure (200° C) | $3 \times 10^{-9}$ Torr |
| Lithium vapor pressure (320° C) | $2.2 \times 10^{-6}$ Torr |
| Lithium inventory | 566 liters |
| Lithium flow rate | 18 liters/sec (285GPM) |
| Effective target volume | 6000 $cm^3$ |
| Evaporation rate (T = 179° C) | $6 \times 10^{-15}$ g/$cm^2$sec |
| Evaporation rate (T = 325° C) | $6.3 \times 10^{-11}$ g/$cm^2$sec |

TABLE II

| Cavity | Basic Linac Parameters 1 | 2 | 3 | 4 | 5 | 6 | 7 | 8 |
|---|---|---|---|---|---|---|---|---|
| Input Energy (MeV) | 0.500 | 3.967 | 7.772 | 11.352 | 15.048 | 18.636 | 22.614 | 26.226 |
| Input $\beta\gamma$ | 0.023 | 0.063 | 0.089 | 0.108 | 0.125 | 0.139 | 0.153 | 0.165 |
| Output Energy (MeV) | 3.967 | 7.772 | 11.352 | 15.048 | 18.636 | 22.614 | 26.226 | 30.109 |
| Output $\beta\gamma$ | 0.063 | 0.089 | 0.108 | 0.125 | 0.139 | 0.153 | 0.165 | 0.177 |
| Cavity Dia. (m) | 3.78 | 3.78 | 3.78 | 3.78 | 3.78 | 3.78 | 3.78 | 3.78 |
| Cavity Length (m) | 4.662 | 5.075 | 4.928 | 4.784 | 5.303 | 4.816 | 5.178 | |
| | | 4.773 | | | | | | |
| Input Cell Length (m) | 0.139 | 0.390 | 0.547 | 0.661 | 0.761 | 0.848 | 0.934 | 1.007 |
| Output Cell Length (m) | 0.376 | 0.532 | 0.647 | 0.747 | 0.833 | 0.920 | 0.992 | 1.067 |
| Input Gap/Length Radio (g/L) | 0.200 | 0.236 | 0.259 | 0.275 | 0.290 | 0.304 | 0.319 | 0.334 |
| Output Gap/Length Ratio (g/L) | 0.234 | 0.257 | 0.273 | 0.288 | 0.301 | 0.316 | 0.330 | 0.350 |
| Input Drift Tube Length (m) | 0.111 | 0.298 | 0.405 | 0.479 | 0.540 | 0.590 | 0.636 | 0.671 |
| Output Drift Tube Length (m) | 0.288 | 0.395 | 0.470 | 0.532 | 0.582 | 0.629 | 0.665 | 0.694 |
| Drift Tube Diameter (m) | 0.720 | 0.720 | 0.720 | 0.720 | 0.720 | 0.720 | 0.720 | 0.720 |
| Drift Tube Aperture (m) | 0.040 | 0.060 | 0.060 | 0.080 | 0.080 | 0.080 | 0.080 | 0.080 |
| Drift Tube Inner Corner Radius (m) | 0.040 | 0.040 | 0.040 | 0.040 | 0.040 | 0.040 | 0.040 | 0.040 |
| Drift Tube Outer Corner Radius (m) | 0.080 | 0.080 | 0.080 | 0.080 | 0.080 | 0.080 | 0.080 | 0.080 |
| Drift Tube Stem Dia. (m) | 0.050 | 0.080 | 0.080 | 0.080 | 0.080 | 0.080 | 0.080 | 0.080 |
| Quad. Aperture (m) | 0.050 | 0.070 | 0.070 | 0.090 | 0.090 | 0.090 | 0.090 | 0.090 |
| Quad. Length (m) | 0.100 | 0.200 | 0.200 | 0.400 | 0.400 | 0.400 | 0.400 | 0.400 |
| Quad. Field Strength (kG/cm) | ~1.00 | ~0.50 | ~0.25 | ~0.25 | ~0.25 | ~0.25 | ~0.25 | ~0.25 |

TABLE III

| | |
|---|---|
| Injection energy | 0.5 MeV |
| Injection $\beta = v/c$ | 0.023 |
| Accelerated current (I) | 0.1 A |
| Injected transverse emittance ($\epsilon$) | $3\pi \times 10^{-4}$ mrad |
| Radio frequency (f) | 50 MHz ($\lambda = c/p = 6$ m) |
| Acceleration rate | 0.75 MeV/m |
| Synchronous phase ($\phi_s$) | −30° |
| Initial drift-tube bore diameter | 4 cm |

TABLE IV

Principal Characteristics of the Deuteron Linac

Beam Characteristics

1. Maximum energy 30 MeV
2. Average acceleration rate 0.75 MeV/m
3. Energy variable above 10 MeV in steps of about 5 MeV (10, 15, 20, 25, 30 MeV)
4. Beam microstructure, 4-nsec pulses separated by 200 nsec at 50 MHz.
5. Time structure at the target, beam debunched at target essentially dc with maximum 5%, 50-MHz flux modulation 6. Average current 100 mA ($6.2 \times 10^{17}$ deuterons/sec) ($D^+$ beam)
7. Beam duty cycle 100% (cw operation)

At design conditions, the pump is capable of pumping 360 GPM at a temperature of up to 1,050° F and at 20 psig.

TABLE VII

| E(deut) (MeV) | $(E_n(O°))$ (MeV) | Neutron-Yields From Li(d,n) Reaction in Neutrons/sr-C Y(O°) | Y(5°) | Y(10°) | Y(15°) | Y(20°) |
|---|---|---|---|---|---|---|
| 13.42 | 7.63 | $9.685 \times 10^{15}$ | $9.419 \times 10^{15}$ | $7.810 \times 10^{15}$ | $6.338 \times 10^{15}$ | $4.992 \times 10^{15}$ |
| 18.95 | 8.46 | $3.247 \times 10^{16}$ | — | — | — | — |
| 24.84 | 10.32 | $7.129 \times 10^{16}$ | — | — | — | — |
| 28.94 | 12.21 | $1.057 \times 10^{17}$ | — | — | — | — |
| 34.06 | 14.46 | $1.469 \times 10^{17}$ | $1.313 \times 10^{17}$ | $0.8687 \times 10^{17}$ | $0.5904 \times 10^{17}$ | $0.4160 \times 10^{17}$ |

8. Average beam power 3 megawatts ($D^+$ beam)
9. Beam pulsing possible

Accelerator Physical Characteristics

1. Total length of accelerator 40 m made up of 8 cavities, each about 5 m long and 3.8 m diameter
2. Injectors 2 × 500-kV, 0.5A power supplies
3. Total rf power ~ 4.5 megawatts for 100 mA
4. Strong focusing utilizing electromagnetic quadrupoles

TABLE VIII

| Vapor Pressure of Liquid Lithium vs Temperature: Vapor Pressure (Torr) | Temperature (° C) |
|---|---|
| $10^{-6}$ | 305 |
| $10^{-5}$ | 350 |
| $10^{-4}$ | 402 |
| $10^{-3}$ | 463 |
| $10^{-2}$ | 537 |
| $10^{-1}$ | 630 |
| 1 | 743 |
| 10 | 890 |
| 100 | 1094 |
| 760 | 1343 |

TABLE V

| Radio Frequency Parameters: Cavity No. | 1 | 2 | 3 | 4 | 5 | 6 | 7 | 8 |
|---|---|---|---|---|---|---|---|---|
| (Joules) | 90 | 92 | 81 | 92 | 90 | 100 | 91 | 102 |
| Average Shunt Impendance (MΩ/m) | 32 | 36 | 36 | 36 | 37 | 37 | 37 | 37 |
| Total Cavity Pwr (kW) | 207 | 182 | 158 | 169 | 161 | 178 | 162 | 177 |
| Total Beam Pwr for 100 mA (kW) | 347 | 380 | 358 | 370 | 359 | 398 | 361 | 388 |
| Unloaded Q Value | 137,280 | 158,900 | 162,650 | 171,270 | 174,400 | 176,900 | 176,910 | 181,060 |
| Input Transit-Time Factor | 0.70 | 0.80 | 0.85 | 0.84 | 0.81 | 0.81 | 0.80 | 0.80 |
| Output Transit-Time Factor | 0.83 | 0.84 | 0.86 | 0.81 | 0.81 | 0.81 | 0.80 | 0.79 |
| Stable Phase Angle | −30° | −30° | −30° | −30° | −30° | −30° | −30° | −30° |

TABLE VI

Conventional Liquid Metal Pump Parameters

Westinghouse Model T-502-Al (as shown in FIG. 18 Tech. Manual 5710-13-A, June '59 which is incorporated by reference herein) as adapted to circulate liquid metal through test devices to furnish operating experience for radioactive services. When the pump is in operation, the liquid metal flows by gravity from a surge tank (provided by the system in which the pump is mounted) through conventional piping and into a suction nozzle in the bottom of the pump casing. The impellor rotating inside the pump casing forces liquid metal through the discharge nozzle in the pump casing, into the piping of the test loop and back again to the surge tank. This flow continues as long as the pump is in operation.

The pump is hermetically sealed to prevent leakage of liquid metal since not all sections of the pump contain liquid metal. These sections are filled with an inert gas. The level of the liquid metal in the pump if controlled by regulating the pressure of the inert gas.

Essentially the pump is a vertical, single stage, centrifugal pump. It has three distinct flow systems: (1) liquid metal, which enters and leaves the pump casing and circulates in the system piping, (2) an inert gas, which fills the pump sections lacking liquid metal, and (3) cool air, which is circulated by the pump air cooling system to cool the motor components.

What is claimed is:

1. Target means for charging particles, comprising:

a. first source means for producing a beam of deuterons;

b. longitudinally extending container means having sides terminating in closed ends for transporting the beam of deuterons along an axis toward one end of the container means; and c. second source means of a flowing liquid lithium stream having a nozzle defining a narrow vent in one side of the container means adjacent the one end thereof for converting the flowing liquid lithium stream into a falling, gushing, liquid lithium jet that flows by gravity as a sheet-shaped web along and across the one end of the container means in a direction transverse to the axis of the container means to interact the liquid lithium with the beam of deuterons.

2. The system of claim 1 in which the container means is evacuated to provide the interaction in a low pressure vacuum.

3. The system of claim 2 in which the nozzle has a transition piece that converts the flowing liquid lithium stream from a round cross-section along a vertical axis to a falling, gushing, liquid lithium jet having a rectangular cross-section parallel to the beam axis.

4. The system of claim 3 having recovery means including a transition piece that converts the rectangular cross-section, falling, gushing, liquid lithium jet into a round cross-section flowing liquid lithium stream.

5. The system of claim 4 in which the container means has a vacuum tight bulkhead forming a neutron window between the falling, gushing, liquid lithium jet and the outside of the container means for maintaining the integrity of the low pressure ambient in the vicinity of and adjacent to the liquid lithium jet.

6. The system of claim 5 in which the second source means causes the falling, gushing, liquid lithium jet to hub the inside of the neutron window in the low pressure vacuum in the container means.

7. The system of claim 6 having means on the sides of the neutron windoe forming a U-shaped trough or receiving and transporting the falling, gushing, liquid lithium jet in the low pressure vacuum in the container means.

8. The system of claim 7 in which the recovery means has an auxiliary catch basin and a drain from the low pressure ambient in the container means for returning to the second source means any liquid lithium that is not recovered from the falling, gushing, liquid lithium jet in the low pressure ambient in the container means by the transisiton piece of the recovery means.

9. The system of claim 8 in which the first source means has deuteron source and accelerator means for producing $D^+$ and $D^-$ deuteron beams along the axis for producing neutrons via break-up of the beams by stripping, spallation and compound nuclear reactions in and on the falling, gushing, liquid lithium jet in the low pressure ambient, wherein the deuterons disintegrate into protons and neutrons.

10. Target means for charging particles, comprising:

a. a charged particle beam;

b. vacuum container means having an inside wall for receiving the beam;

c. vent means on the inside of the vacuum container means adjacent said wall and direct along a trajectory transverse to the charged particle beam; and d. a falling, copiously flowing liquid lithium target jet that gushes by gravity from the vent means transverse to the charged particle beam to form a moving web in contact with the wall of the container means for receiving the beam to produce a neutron beam in the same direction as the charged particle beam.

11. The target means of claim 10 in which the vent has a rectangular cross-section opening.

12. The target means of claim 11 in which the target jet is an endlessly circulating sheet-shaped, liquid lithium jet having a rectangular cross-section when it is bombarded by the charged particle beam.

* * * * *